US010969197B2

(12) United States Patent
Theisinger et al.

(10) Patent No.: US 10,969,197 B2
(45) Date of Patent: Apr. 6, 2021

(54) WEAPON SIGHT

(71) Applicants: Hermann Theisinger, Vienna (AT); Mok Kwok Ho, Hong Kong (HK)

(72) Inventors: Hermann Theisinger, Vienna (AT); Mok Kwok Ho, Hong Kong (HK)

( * ) Notice: Subject to any disclaimer, the term of this patent is extended or adjusted under 35 U.S.C. 154(b) by 0 days.

(21) Appl. No.: 16/254,022

(22) Filed: Jan. 22, 2019

(65) Prior Publication Data

US 2020/0232760 A1 Jul. 23, 2020

Related U.S. Application Data

(60) Provisional application No. 62/620,343, filed on Jan. 22, 2018.

(51) Int. Cl.

| | |
|---|---|
| ***F41G 1/34*** | (2006.01) |
| ***F41G 1/02*** | (2006.01) |
| ***F41G 1/06*** | (2006.01) |
| ***F41G 1/10*** | (2006.01) |

(52) U.S. Cl.

CPC ..... *F41G 1/345* (2013.01); *F41G 1/02* (2013.01); *F41G 1/10* (2013.01)

(58) Field of Classification Search

CPC ..... F41G 1/01; F41G 1/06; F41G 1/30; F41G 1/345; F41G 1/32; F41G 1/02

See application file for complete search history.

(56) References Cited

U.S. PATENT DOCUMENTS

| | | | | |
|---|---|---|---|---|
| 2,596,522 | A * | 5/1952 | Bethke | F41G 1/345 42/113 |
| 2,925,657 | A * | 2/1960 | Stenby | F41G 1/32 42/114 |
| 3,192,632 | A * | 7/1965 | Von Stavenhagen | F41G 1/02 42/144 |
| 3,346,962 | A * | 10/1967 | Luebkeman | G02B 23/14 42/144 |
| 3,362,074 | A * | 1/1968 | Luebkeman | F41G 1/027 42/144 |
| 3,565,539 | A * | 2/1971 | La Russa | F41G 1/30 356/251 |
| 3,698,092 | A | 10/1972 | Rosenhan et al. | |
| 3,914,873 | A * | 10/1975 | Elliott, Jr. | F41G 1/345 42/132 |
| 4,434,560 | A * | 3/1984 | Comeyne | F41G 1/345 42/114 |
| 4,945,667 | A * | 8/1990 | Rogalski | F41G 1/34 42/114 |
| 5,065,538 | A * | 11/1991 | Allen | F41G 1/345 42/142 |
| 5,068,969 | A * | 12/1991 | Siebert | F41G 1/345 362/110 |
| 5,735,070 | A * | 4/1998 | Vasquez | F41A 9/62 42/1.02 |

(Continued)

*Primary Examiner* — Derrick R Morgan

(74) *Attorney, Agent, or Firm* — ATIP Law; Ian Burns

(57) ABSTRACT

An open sight for use on weapons such as handguns is introduced. The open sight features two rear aiming marks which are illuminated by an artificial light source mounted in the rear sight. A third aiming mark in the front sight is illuminated by a forward-facing light source also mounted in the rear sight. The front sight is dimensioned to substantially block the forward directed beam to reduce the visibility of the illumination forward of the weapon.

22 Claims, 5 Drawing Sheets

(56) References Cited

U.S. PATENT DOCUMENTS 5,956,854 A * 9/1999 Lorocco ..... F41G 1/32 42/132
6,035,539 A * 3/2000 Hollenbach ..... F41G 1/32 42/132
6,385,855 B1 * 5/2002 Tymianski ..... F41G 1/345 33/263
6,412,208 B1 * 7/2002 Mikuta ..... F41G 1/345 42/132
6,604,315 B1 * 8/2003 Smith ..... F41G 1/027 42/111
7,921,591 B1 * 4/2011 Adcock ..... F41G 1/14 42/113
8,443,542 B1 * 5/2013 Galbraith ..... F41G 1/08 42/113
9,212,867 B2 * 12/2015 Patterson ..... F41C 33/0254
9,658,030 B1 * 5/2017 Heacock ..... F41G 1/01
9,869,525 B1 * 1/2018 Howe ..... F41G 1/32
9,909,838 B1 * 3/2018 Jackson ..... F41G 1/02
10,088,275 B1 * 10/2018 Warren ..... F41C 3/00
10,180,306 B2 * 1/2019 Ben Zion ..... F41G 1/10
10,451,383 B1 * 10/2019 Stephenson ..... F41G 1/345
10,527,389 B2 * 1/2020 Martin ..... G01B 11/02
2002/0073560 A1 * 6/2002 LoRocco ..... F41G 1/467 33/265
2002/0073597 A1 * 6/2002 LoRocco ..... F41G 1/16 42/111
2002/0157298 A1 * 10/2002 Carlson ..... F41G 1/345 42/132
2003/0079396 A1 * 5/2003 Brown ..... F41G 1/345 42/133
2003/0121197 A1 * 7/2003 Howe ..... F41G 1/01 42/132
2007/0032885 A1 2/2007 Cross et al.
2007/0107292 A1 * 5/2007 Bar-Yona ..... F41G 1/027 42/144
2008/0192245 A1 * 8/2008 Stenton ..... F41G 1/345 356/251
2010/0088944 A1 * 4/2010 Callihan ..... F41G 1/01 42/145
2011/0107650 A1 * 5/2011 Howe ..... F41G 1/10 42/132
2015/0153136 A1 * 6/2015 Howe ..... F41G 1/345 42/111
2016/0091281 A1 * 3/2016 Gwillim, Jr. ..... F41G 1/345 42/111
2016/0216070 A1 * 7/2016 Hancosky ..... F41G 1/38
2017/0016697 A1 * 1/2017 Jones ..... F41G 1/345
2017/0321992 A1 * 11/2017 Erdle ..... F41G 1/345
2018/0180381 A1 * 6/2018 Grace, Jr. ..... F41C 23/10
2018/0195835 A1 * 7/2018 Crispin ..... F41G 1/30
2018/0224242 A1 * 8/2018 Bellah ..... F41G 1/38
2019/0107368 A1 * 4/2019 Ben Zion ..... F41G 1/10

* cited by examiner

WEAPON SIGHT

CROSS REFERENCE TO RELATED APPLICATIONS

This application claims priority to U.S. provisional patent application Ser. No. 62/620,343, filed 22 Jan. 2018, the contents of which is herein incorporated by reference.

FIELD OF THE INVENTION

The present invention relates to sighting devices used on small arms. More specifically, it relates to illuminated open sights used on handguns or other small arms.

BACKGROUND

"Iron sights" are sighting devices used to assist in the aiming of small arms such as rifles and hand guns. Iron sights are typically composed of two component sights formed by metal blades: a rear sight mounted perpendicular to the line of sight and a front sight that is a post or bead. "Open sights" are a special form of iron sights which use a notch of some sort as the rear sight. This distinguishes them from "aperture sights" that use a circular hole as the rear sight. Civilian, hunting, and police firearms usually feature open sights, while many military battle rifles employ aperture sights.

Open sights have many advantages: they are inexpensive to produce, uncomplicated to use, sturdy, lightweight and resistant to environmental conditions. Over the years, many developments have been made in the art with the goal of developing an illuminated open sight which can be used in low light or night time conditions. An early example is U.S. Pat. No. 2,529,057 granted on Nov. 7, 1950. This patent discloses an illuminated gun sight which uses a small battery-powered electric light bulb. Similarly, U.S. Pat. No. 3,698,092 granted on Oct. 17, 1972 introduces an illuminated open sight that uses light bulbs both in the front sight and in the rear sight. In this patent, the front sight's light source is connected to the rear sight via a wire.

More recent prior art pertaining to this subject include U.S. Pat. No. 6,640,482 issued to Carlson on Nov. 4, 2003. This patent teaches a dual-powered fiber optic sight for guns which can be illuminated either by ambient light or by a light source such as a Light Emitting Diode (LED). Ambient light and light from the LED are carried by a fiber optic rod and the rod appears as a bright dot on the front sight of the gun. In this invention, the battery and the electronics are all put inside a single compartment at the front sight. While this is acceptable on a weapon with a long and relatively large barrel, it is not a viable solution for a small weapon such as a handgun.

Another recent prior art is the electronically illuminated open sight introduced in the patent application by Jones (US Pub. No. 2017/0016697 published on Jan. 19, 2017). In this application, LEDs are used to illuminate fiber optic rods positioned within both the front sight and the rear sight. Each fiber optic rod is viewable through a viewing port in the rear surface of its respected housing, making the illuminated fiber optic rods viewable only to the user of the handgun or rifle. The LEDs are housed within the sight body. Fiber optic cables are run from the LEDs to the illuminated rods in order to transfer light from the LEDs to rods which then serve as illuminated aiming marks. While this is an elegant solution, it is not easy to adapt to handguns having different barrel lengths. For different barrel lengths, custom fiber optic cables must be developed to transfer light from the rear sight to the front sight.

Apart from the above references that teach using illuminated aiming marks in front sights and rear sights, there are also prior art references that utilize a light source (often a laser) to form an illuminated aiming mark directly on the target. Notable examples of this category include Speroni (US Pub. No. 2010/0175297) and Moore et al. (U.S. Pat. No. 8,607,495). It is important to recognize that these "laser sights" use a different principle of operation than the open sights considered in the present application. In the above two references, the laser mounted in the rear sight projects an illuminated aiming mark directly on the target. As such, they do not require the shooter to align aiming marks in the rear sight, the front sight and the target. While such sights are easier to use, their light source (the laser) requires substantial power. Furthermore, the laser itself or the entire sight must be articulated such that the laser beam can be aligned with the point of aim. Another disadvantage is that the laser beam projected towards the target makes the position of the shooter easily detectable by an adversary.

It is evident from the above review of the state of the art that there is a need for a compact and illuminated open sight that can be readily mounted onto handguns with various barrel lengths and that does not project a visible light spot directly on the target.

SUMMARY OF ONE EMBODIMENT OF THE INVENTION

Advantages of One or More Embodiments of the Present Invention

The various embodiments of the present invention may, but do not necessarily, achieve one or more of the following advantages:

the ability to illuminate a sight;

provide a compact illuminated sight;

provide an illuminated sight that can be fitted to weapons of varying barrel lengths;

the ability to illuminate a sight with minimal visibility forward of the weapon;

provide an illuminated sight with all electronic components contained within one piece.

These and other advantages may be realized by reference to the remaining portions of the specification, claims, and abstract.

Brief Description of One Embodiment of the Present Invention

This invention teaches an open sight that features an incoherent front-facing light source to illuminate an aiming mark on the front sight. The front aiming mark comprises a diffuse reflective surface that reflects light back to the shooter's eye so that the front aiming mark is easily viewable under dim light. One or more aiming marks in the rear sight are also illuminated.

In one aspect, there is provided an open sight for use on a weapon such as a handgun. The open sight may comprise a front sight and a rear sight. The rear sight may comprise at least one rear sight aiming mark. A housing of the rear sight may house one or more illumination sources. The one or more illumination sources may be configured, in use, to project light forward from the rear sight and also to illuminate the at least one rear sight aiming mark. The front sight may comprise a reflective surface configured, in use, to at least partially reflect light back from the one or more illumination sources.

In one aspect, there is provided a rear sight of an open sight for use on a weapon such as a handgun. The rear sight may comprise a housing having an internal cavity and a longitudinal length from a front end to a rear end. One or more illumination sources may be disposed within the cavity. First and second projections extending upward of the housing define a sighting notch. Each of the first and second projections may comprise an illuminated aiming mark illuminated by the one or more illumination sources, the illuminated aiming marks projecting light rearward of the rear end. The one or more illumination sources may also project light forward of the front end.

In one aspect, there is provided an open sight for use on a weapon. The open sight may comprise rear sight means and front sight means for aiming the weapon at a target. The rear sight means may comprise aiming mark means for aligning with the front sight means, and illumination means for illuminating the front sight means and the aiming mark means. The front sight means may comprise reflective means for reflecting light from the illumination means.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

Figure 1:
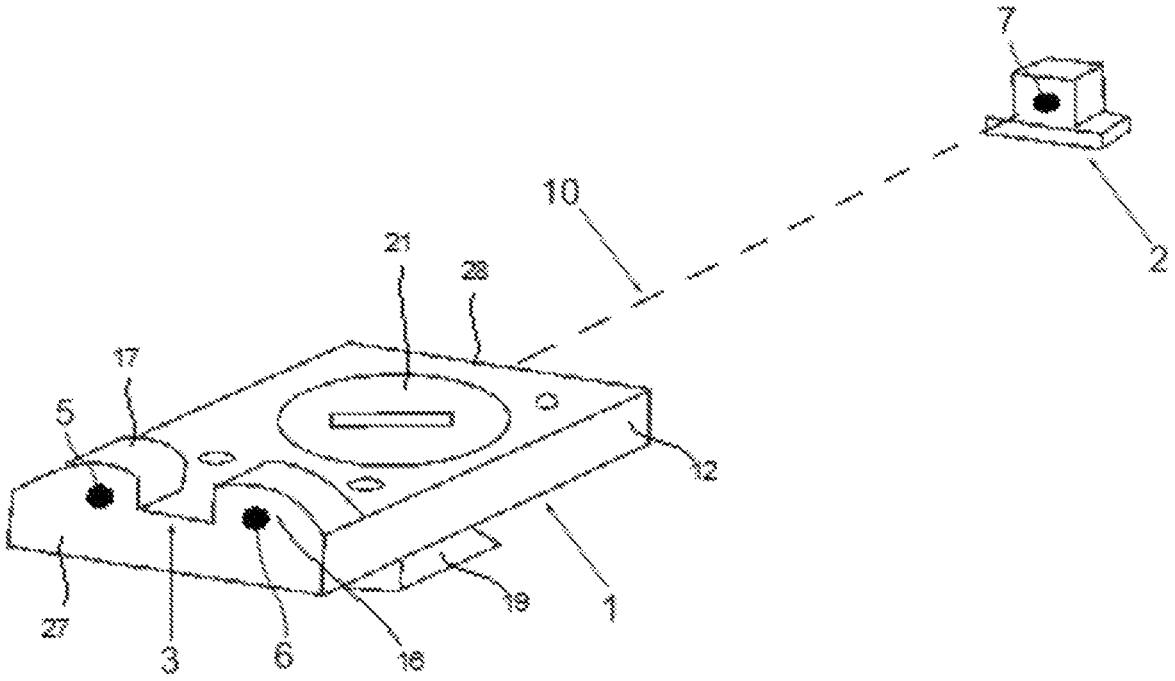
FIG. 1 is a perspective view showing the rear sight and the front sight according to the invention.

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Glossary of Key Terms and Reference Numerals

To help the reader understand the invention better, the names of main components of the invention and their corresponding reference numerals are listed below.

Figure 2:
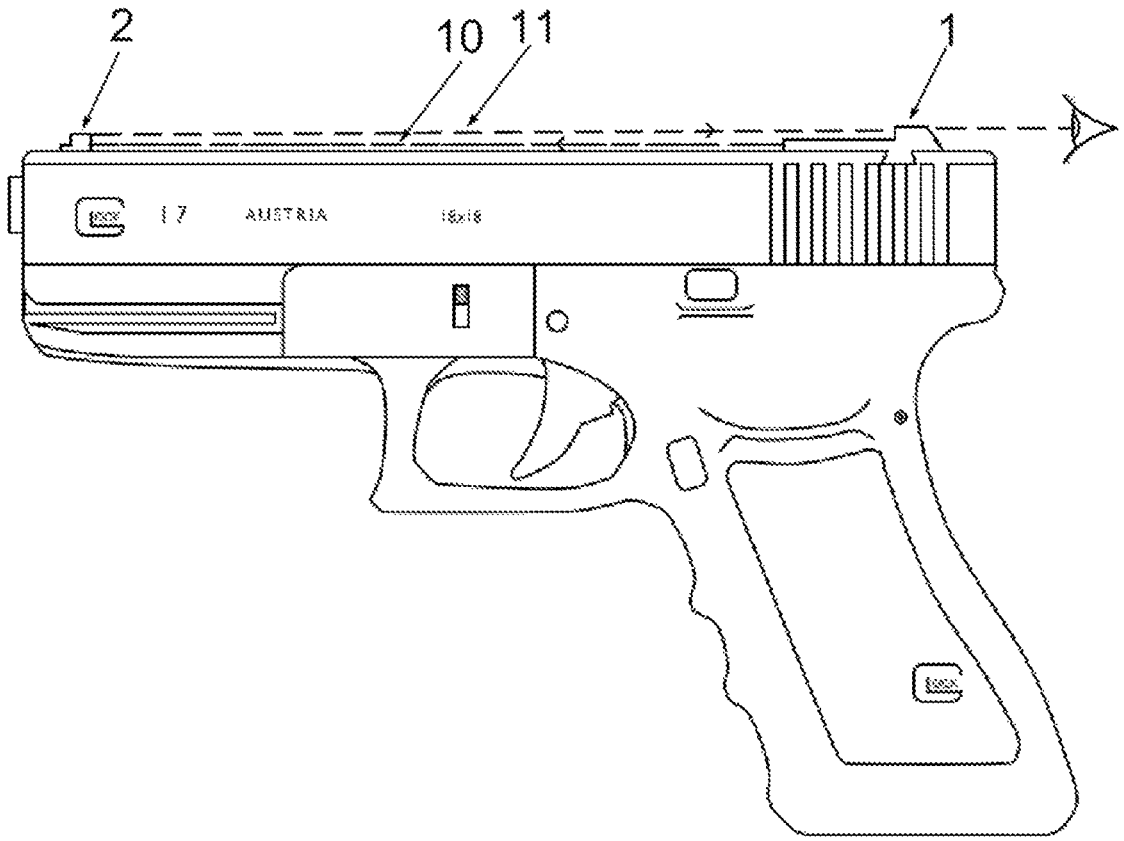
FIG. 2 is a side view showing the rear sight and the front sight being mounted on a handgun. This figure shows how the light source in the rear sight illuminates the front sight and how the shooter views the light reflected back from the front sight through an opening (notch) in the rear sight.
Figure 3:
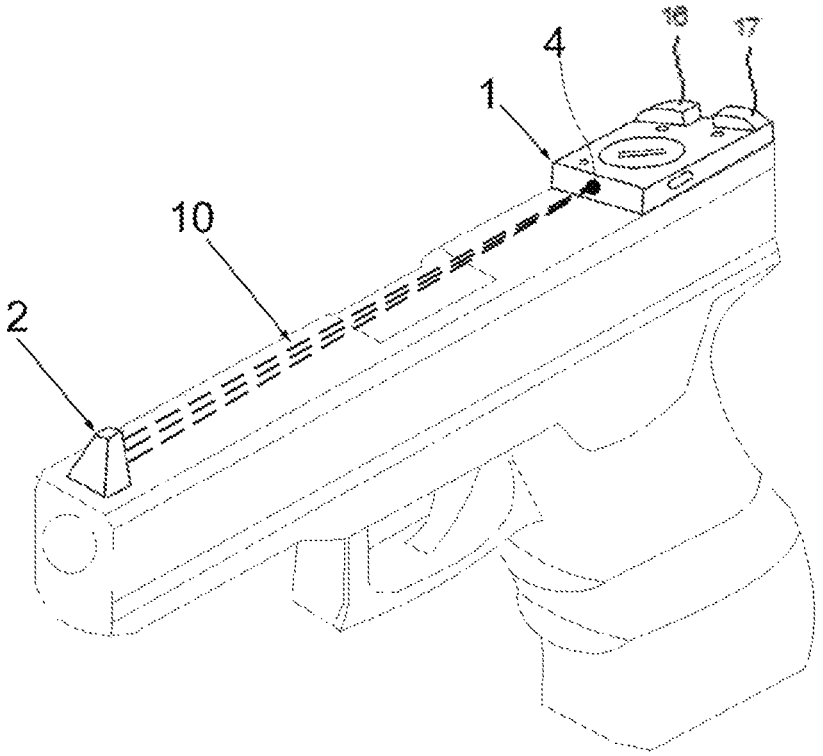
FIG. 3 is a perspective view showing the rear sight and the front sight being mounted on a handgun. This figure shows how the light source in the rear sight illuminates the front sight and how the front sight blocks the light beam from being visible to a viewer located directly in front of the handgun.

1. Rear Sight
2. Front sight
3. Opening (notch)
4. First artificial light source
5. First aiming mark (rear sight)
6. Second aiming mark (rear sight)
7. Third aiming mark (front sight)
10. Light beam emerging from the artificial light source
11. Light beam reflected from the front sight
14. Second artificial light source
15. Light pipe
21. Battery cover
25, 26. high-visibility circular aiming marks The open sight according to the present invention comprises a rear sight (1) and a front sight (2) (See, e.g., FIG. 1.) The rear sight (1) is mounted on the top surface of a handgun's receiver close to its rear end. The front sight (2) is mounted on the top surface of the receiver close to the muzzle end (FIG. 2 or 3).

The rear sight (1) has a substantially hollow body (12) that includes electronic components to be described below including one or more illumination sources, a power source (e.g. battery), switches and associated circuitry. The internal cavity (13) of the rear sight (1) may be accessed via a removable battery cover (21). In one embodiment, the battery may be a 3 Volt CR2032 lithium battery. In one embodiment, the battery may be a rechargeable battery that is rechargeable via a charging port, such as a micro-USB port. Other batteries will be apparent to the person skilled in the art and will depend on the illumination sources and other components utilized, as will be described in more detail below.

Externally, the housing body (12) of the rear sight (1) has a length extending along a longitudinal axis between a front end (28) and a rear end (27). The terms longitudinal, front, rear, etc. are used herein with reference to the weapon on which the sight will be deployed, rather than to the particular shape and configuration of the housing body 12. That is, a weapon has an apparent longitudinal axis, front end and rear end, as would be understood by the person skilled in the art and the rear sight has a corresponding front, rear and longitudinal axis. The housing body (12) is substantially rectangular with a low profile sufficient for housing the battery and electronics. The lower surface of the housing may be provided with one or more formations (19), such as a laterally extending wedge shown in FIG. 1, that enable the rear sight to be secured to a handgun. The size, shape and position of any such formations will be dependent on the type of weapon on which the rear sight is to be deployed.

Extending upward of a top surface of the housing body are two projections (16), (17) that define a sighting notch (3) between them through which the front sight may be sighted in use. Disposed within these projections (16), (17), the rear sight comprises two aiming marks (5) and (6) formed as openings in the housing body. The aiming marks may be circular in shape and may be illuminated as described later in the specification. The front sight comprises a third aiming mark (7). The rear sight (2) includes an opening or notch (3) between the aiming marks (5) and (6) such that the front aiming mark (7) will be visible when viewed from a position behind the weapon with the shooter's eye being positioned at the same height as the top surface of the receiver.

To aim the weapon, the shooter must laterally align the rear aiming marks (5) and (6) with the front aiming mark (7) and, additionally, hold the weapon such that the front aiming mark (7) is aligned with the target.

A key feature of the present invention is that the rear aiming marks (5) and (6) are illuminated using one or more artificial light sources inside the rear sight and the front aiming mark (7) is illuminated indirectly via a forward-facing artificial light source also mounted in the rear sight.

Figure 4:
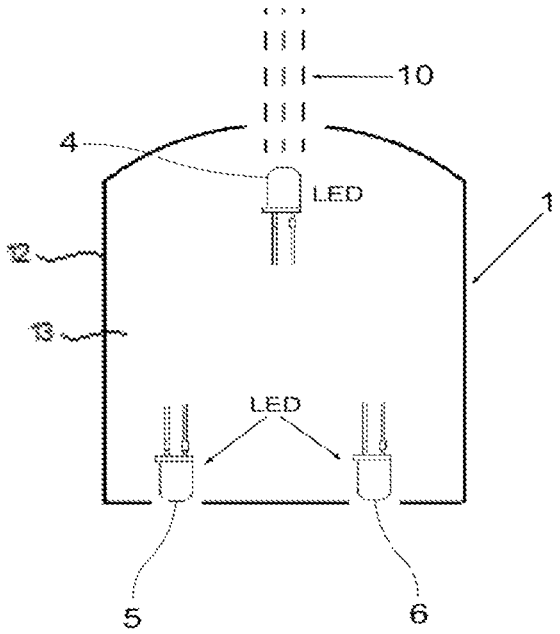
FIG. 4 is a top view of the rear sight wherein Light Emitting Diodes (LEDs) are used as illumination sources.
Figure 5:
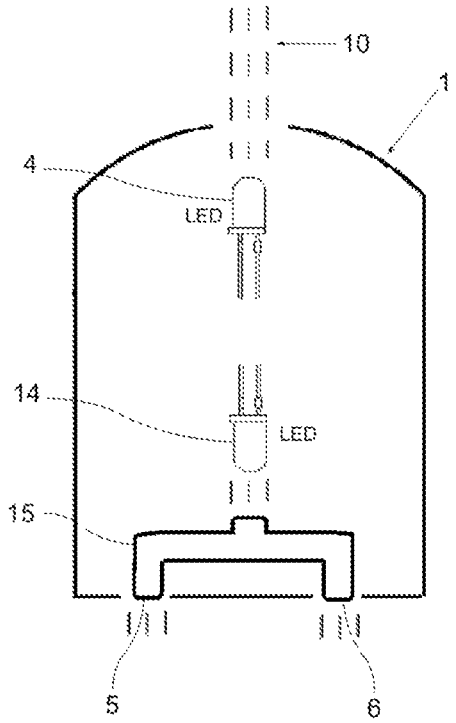
FIG. 5 is a top view showing a variation of the invention wherein a front-facing LED is used to illuminate the front aiming mark and a rear-facing Led is used to illuminate the rear aiming marks indirectly via a light pipe.

With reference to FIGS. 4 and 5 which show internal views of the rear sight (1) in alternative embodiments, an incoherent artificial light source (4) is positioned in the front section of the housing cavity (13) of the rear sight (1) such that it emits a visible light beam (10) towards the front sight (2). The artificial light source (4) can be a Light Emitting Diode (LED) or any other suitable electrical light source that emits an incoherent light beam. (That is, a light beam with frequent and random changes of phase between the photons.) This includes tungsten filament lamps and ordinary fluorescent tubes which emit incoherent visible light.

A portion of the light beam (10) is reflected back towards the shooter's eye forming the reflected light beam (11). This beam is visible to the shooter through the opening (3) formed in the rear sight (1) between the sighting projections (16), (17). The height and the width of the light beam (10) and the dimensions of the front sight (2) are chosen such that the light beam emerging from the light source (4) is not visible to an adversary located directly in front of the gun's muzzle. FIG. 3 shows how the light source in the rear sight illuminates the front sight and how the front sight blocks the direct longitudinal light beam (10) from the light source. This reduces the degree to which light from the rear sight may be visible to a viewer located directly in front of the handgun.

The third (front) aiming mark (7) comprises a diffuse reflective surface. Diffuse reflection is the reflection of light from a surface such that a ray incident on the surface is scattered at many angles rather than at just one angle as in the case of a mirror. A surface built from a non-absorbing powder such as plaster, or from fibers such as paper, or from a polycrystalline material such as white marble, reflects light diffusely with great efficiency. Persons skilled in the art would be familiar with diffuse reflection and can choose a suitable reflective material to be used in the front sight.

The open sight disclosed in this invention has several advantages:

- No battery or illumination device is needed in the front sight
- All electronic components are contained within the rear sight
- No need to run fiber optic cables or electrical wires to illuminate the front site.

This makes the illuminated sight introduced in this invention easily adaptable to handguns with different barrel lengths.

- In contrast to laser sights, the light beam is not visible by the adversary.
- The front-facing light source mounted in the rear sight may also illuminate the top surface of the receiver with a faint glowing light making the handgun more visible and easier to aim in low-light conditions.

The aiming marks in the rear sight can be illuminated in several ways:

In a first preferred embodiment of the invention, the illuminated aiming marks (5) and (6) are simply formed by additional artificial light sources (LEDs, for example) mounted in the rear sight (FIG. 4). While LEDs are preferred, it is possible to use any other suitable electrical light source that emits an incoherent light beam.

The power of the LEDs should be chosen so as to provide adequately visible aiming marks during low light conditions while not being so bright that they obstruct the user's view of the target.

Figure 6:
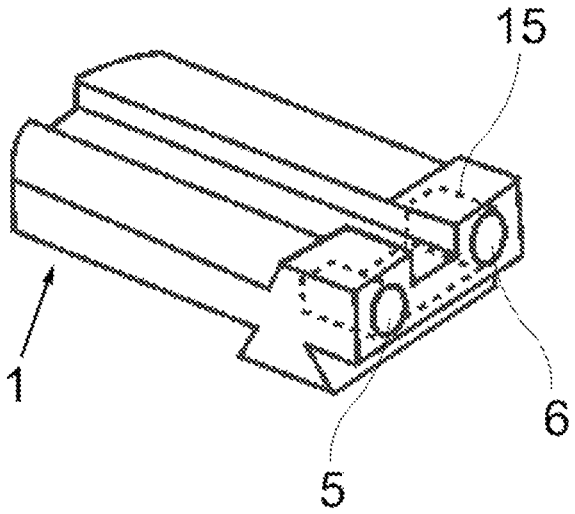
FIG. 6 is a perspective view showing a variation of the invention wherein a rear-facing LED is used to illuminate the rear aiming marks indirectly via a light pipe.

In a second preferred embodiment of the invention (FIG. 5), a second artificial light source (14) is used to illuminate both rear aiming marks via a light pipe (15). The second artificial light source (14) is preferably an LED. It can also be made from any other electrical light source that emits an incoherent light beam. The light pipe (15) may be made from acrylic, glass or other suitable material. The light pipe (15) is positioned inside the rear sight (1) such that its receiving end is close to the second artificial light source (14). The light pipe (15) has two exit ends. These exit ends form the aiming marks (5) and (6) and are visible to the shooter (FIG. 6).

For either embodiment, the electronic components are powered by a battery (omitted for clarity in FIGS. 4 and 5) or other suitable power source. A switch (not shown) such as a push button or toggle, may be provided on the body of the rear sight for selectively activating the light sources.

Figure 7:
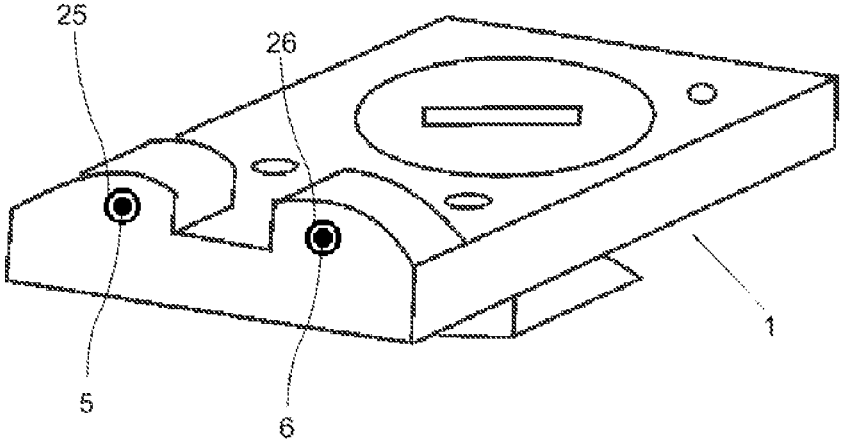
FIG. 7 is a perspective view of a variation of the invention wherein circular shapes are painted around the rear aiming marks using high-visibility paint.

FIG. 7 shows an optional embodiment wherein the visibility of the rear aiming marks during daylight is enhanced by the addition of high-visibility aiming marks (25) and (26) around the illuminated rear aiming marks (5) and (6). In the particular embodiment, the high-visibility aiming marks are circles (25) and (26) formed around the rear aiming marks (5), (6) though other markings, such as crosshairs, would be apparent to the person skilled in the art. Similarly, the visibility of the front aiming mark (7) during daylight can be enhanced by the addition of a high-visibility aiming mark around it (not illustrated). High-visibility aiming marks may be formed in any way known in the art, including by applying high-visibility paint (or highly reflective paint) to portions of the rear sight and/or the front sight.

For simplicity and brevity, non-essential components of the invention such as the battery and the electronic circuits required to operate the LED light source(s) are not described. Persons skilled in the art would be familiar with designing suitable electronic circuits, switches and battery compartments for the invention and would be able to arrange these components within the rear sight (1) as required.

In one embodiment, the illumination unit may be activated by a tilt sensor, such as a mini-ball type sensor. In one embodiment, the unit may turn on with a tilt, which may also require activation of a button. Settings, such as brightness of the illumination, may also be changed using a change setting button in conjunction with whether the unit is tilted or not. Other settings that can be changed include an auto-off timer.

How to Use the Invention

To use the illuminated open sight disclosed in this invention, the user must install the rear sight (1) and the front sight (2) on his weapon's receiver such that the rear aiming marks (5) and (6) are positioned at the same height as the front aiming mark (7) when measured from the axis of the barrel. Additionally, the front aiming mark (7) must be positioned such that when viewed through the opening (3), the axis of view thus formed is parallel with the axis of the weapon's barrel.

To aim his weapon using the illuminated open sight described in this invention, the shooter must laterally align the two rear aiming marks (5) and (6) with the front aiming mark (7), i.e. place the front aiming mark (7) level and between the two rear aiming marks (5) and (6) and, additionally, hold the weapon such that the front aiming mark (7) is longitudinally aligned with the target.

Although the description above contains many specifications, these should not be construed as limiting the scope of the invention but as merely providing illustrations of some of the embodiments of this invention. Thus, the scope of the invention should be determined by the appended claims and their legal equivalents rather than by the examples given.

What is claimed is:

1. An open sight for use on a weapon such as a handgun, the open sight comprising:

(A) a rear sight comprising:

(a) a housing;

(b) at least one rear sight aiming mark;

(c) two or more illumination sources disposed within the housing and configured, in use, to:

(i) project light forward from the rear sight; and (ii) illuminate the at least one rear sight aiming mark; and (B) a front sight comprising a rearward facing reflective surface configured, in use, to at least partially reflect light back from the rear sight;

wherein at least one of the two or more illumination sources projects light from the rear sight through an air gap between the housing of the rear sight and the front sight and onto the rearward facing reflective surface.

2. The open sight of claim 1 wherein the one two or more illumination sources comprises:

(A) at least one first illumination source that projects light forward from the rear sight;

(B) at least one second illumination source that illuminates the at least one rear sight aiming mark.

3. The open sight of claim 2 wherein the at least one second illumination source is configured, in use, to project light backward from the rear sight through the at least one rear sight aiming mark.

4. The open sight of claim 2 wherein the rear sight comprises a body, at least two projections extending upward of the body, at least two aiming marks on the at least two projections, wherein the at least one second illumination source is configured, in use, to project light backward from the rear sight through the at least two aiming marks, wherein the at least two projections are laterally spaced to define a notch between them that, in use, allows a user to sight the front sight through the notch and laterally align the front sight with the at least two aiming marks.

5. The open sight of claim 4 wherein the at least one second illumination source comprises at least one illumination source for each of the at least two aiming marks.

6. The open sight of claim 4, comprising a light pipe comprising a receiving end for receiving light from the two or more illumination sources and at least two exit ends adjacent the at least two aiming marks, wherein, in use, light conveyed through the light pipe from the two or more illumination sources is projected rearward through the at least two aiming marks.

7. The open sight of claim 1 wherein the reflective surface comprises a diffuse reflective surface.

8. The open sight of claim 1 wherein the two or more illumination sources comprise at least one artificial light source that produces a forward directed beam of visible incoherent light.

9. The open sight of claim 8 wherein a width and a height of the beam is smaller than a width and a height of the front sight such that front sight blocks the beam forward of the front sight.

10. The open sight of claim 8 wherein, in use, the front sight is disposed to block a longitudinal axis of the forward directed beam.

11. The open sight of claim 1 comprising an actuator for selectively actuating the two or more illumination sources, the actuator comprising a tilt sensor.

12. A rear sight of an open sight for use on a weapon such as a handgun, the rear sight comprising:

(A) a housing comprising:

(a) an internal cavity;

(b) a longitudinal length having a front end and rear end;

(B) two or more illumination sources disposed within the cavity, the two or more illumination sources comprising:

(a) at least one first illumination source that projects a beam of light forward from the rear sight;

(b) at least one second illumination source;

(C) first and second projections extending upward of the housing, the projections defining a sighting notch;

(D) each of the first and second projections comprising an illuminated aiming mark illuminated by the at least one second illumination source, the illuminated aiming marks projecting light rearward of the rear end;

(E) wherein the at least one first illumination source projects a beam of light forward from the rear sight into an air gap outside the housing.

13. The rear sight of claim 12 wherein the at least one first illumination source projects a longitudinal beam along a longitudinal axis of the rear sight.

14. The rear sight of claim 12 wherein the at least one first illumination source projects a visible incoherent beam of light.

15. The rear sight of claim 12 comprising a light pipe comprising:

(A) a receiving end that receives light from the at least one second illumination source; and (B) at least two exit ends that terminate adjacent the aiming marks; wherein the light pipe conveys light from the receiving end to the at least two exit ends.

16. The rear sight of claim 12 comprising an actuator for selectively actuating the two or more illumination sources, the actuator comprising a tilt sensor.

17. An open sight for use on a weapon, the open sight comprising:

(A) rear sight means and front sight means for aiming the weapon at a target;

(B) the rear sight means comprising:

(a) aiming mark means for aligning with the front sight means; and (b) illumination means for illuminating the front sight means and the aiming mark means, the illumination means comprising (i) first illumination means for projecting a beam of light forward from the rear sight;

(ii) second illumination means for illuminating the aiming mark means; and (C) the front sight means comprising rearward facing reflective means for reflecting light from the first illumination means;

wherein the first illumination means projects a beam of light through an air gap between the rear sight means and the front sight means and onto the rearward facing reflective means.

18. The open sight of claim 17 wherein the reflective means comprises diffuse reflective means.

19. The open sight of claim 17 comprising light pipe means for conveying light from the illumination second means to the aiming mark means.

20. The open sight of claim 17, the rear sight means comprising projection means that defines a sighting notch, the aiming mark means disposed on the projection means.

21. The open sight of claim 17 wherein the rear sight means comprises housing means for housing the illumination means.

22. The open sight of claim 1 wherein there is no fiber optic connection between the rear sight and the front sight.

* * * * *